United States Patent [19]

Judickas

[11] 4,286,600

[45] Sep. 1, 1981

[54] EAR PIERCING TOOL

[76] Inventor: Frank J. Judickas, 579 Richmond St., London, Ontario, Canada

[21] Appl. No.: 29,159

[22] Filed: Apr. 11, 1979

[30] Foreign Application Priority Data

Feb. 7, 1979 [CA] Canada ..... 321045

[51] Int. Cl.[3] ..... A61B 17/00

[52] U.S. Cl. ..... 128/330; 227/68; 227/156

[58] Field of Search ..... 128/330, 335.5, 334 R; 219/150 V, 151, 152; 227/54, 61, 52, 68, 156, 55; 281/21 R; 11/1 R

[56] References Cited

U.S. PATENT DOCUMENTS

| | | | |
|---|---|---|---|
| 2,343,982 | 3/1944 | Knowlton | 227/156 X |
| 2,570,048 | 10/1951 | Cooke et al. | 128/330 |
| 3,943,935 | 3/1976 | Cameron | 128/330 |
| 4,009,718 | 3/1977 | Hastings | 128/330 |
| 4,030,506 | 6/1977 | McDonald | 128/330 |
| 4,030,507 | 6/1977 | Mann | 128/330 |

OTHER PUBLICATIONS

Xerox Disclosure Journal, vol. 1, No. 2, (Feb. 1976).

*Primary Examiner*—Stephen C. Pellegrino
*Assistant Examiner*—Michael H. Thaler

[57] ABSTRACT

The present invention relates to a method, an apparatus and an article for piercing tissue especially human ear tissue. A thermoplastic sleeve having a boss on one end is forced through the tissue into contact with a heating member which melts the thermoplastic thus forming a boss on the other end of the sleeve. The sleeve is retained in the tissue and may be used as a pivot or support for an article of jewellery.

6 Claims, 4 Drawing Figures

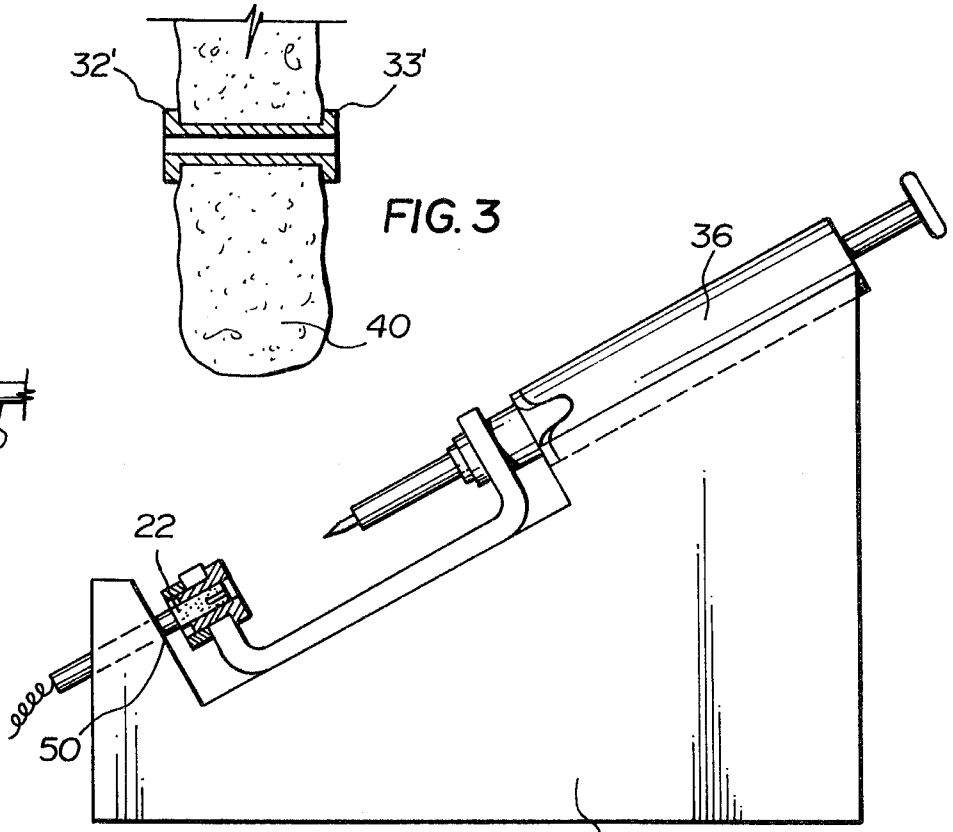
FIG. 4
FIG. 3
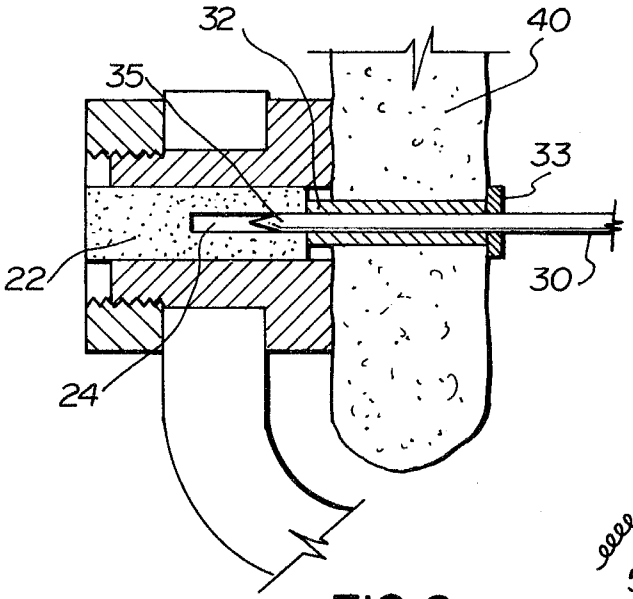
FIG. 2

EAR PIERCING TOOL

BACKGROUND OF THE INVENTION

The present invention relates to a method, an apparatus and an article for piercing tissue. More particularly, the invention provides a simple and practical method and apparatus for inserting through the tissue of an ear a thermoplastic sleeve having a boss on each end.

In the prior art, ear piercing devices are known which force a needle from one leg of a U-shaped support through a portion of an ear and into contact with the other leg of the U-shaped support upon which is formed an anvil. It is also known to force a needle with a head on one end through the tissue of an ear and to then attach a second head at the other end to secure the needle in place, where it remains until the ear is healed. The two heads together with the needle form a so-called "keeper" earring, and a more elaborate article of jewellery cannot be used until healing has taken place.

Many apparatus for forcing a needle through tissue are known in the prior art. Some needles are pushed through simply by the application of manual pressure while others have a spring loaded means which shoots the needle through the ear quickly so as to reduce pain.

SUMMARY OF THE INVENTION

According to the present invention a thin thermoplastic sleeve having a boss on one end is fitted over a needle and forced through the tissue, thence into contact with a heating member which melts the thermoplastic thus forming a boss on the other end of the sleeve. The needle is then removed from the sleeve, thus leaving the sleeve in place in the tissue.

The present invention is intended to be used with human tissue such as a portion of an ear and the sleeve thus retained in the tissue may be used as a pivot or a support for an article of jewelery, although the invention may have broader application.

When the sleeve of the present invention is inserted in a human ear it can be used as a pivot or a support for a conventional earring thus eliminating the necessity for "keeper" earrings that are normally left in place until the damaged tissue heals. One advantage of the present invention, when used with human tissue, therefore is that directly after the piercing operation elaborate jewelery can be worn while the tissue is healing.

The sleeve may be left permanently in place through the pierced tissue. If it is left in place through a human ear, the sleeve helps to prevent injury to the ear such as that caused by insertion of earrings or due to an allergic reaction with earrings.

These sleeves are also advantageous in that they are inexpensive to manufacture. Sterile plastic should be used so that there is no adverse tissue reaction.

More specifically the present invention relates to an improvement in tissue piercing apparatus of the type comprising: a first means for supporting a needle, a second means for supporting an anvil means, means for supportively interconnecting said first and second supporting means in spaced relation and means for shifting the needle towards the anvil means so that tissue interposed between the needle and the anvil means is pierced. According to the present invention the anvil means comprises a heating member so that a thermoplastic sleeve having a first boss preformed at one end, surrounding the needle, after passing through the tissue is thermoformed to form a second boss about its other end thus retaining the sleeve in said tissue.

According to another aspect of the invention there is provided a method of inserting through tissue a thermoplastic sleeve having a boss at each end. The method comprises inserting a sleeve having a first boss at one end through tissue and into contact with a heating member thus forming a second boss at the other end. More specifically the method comprises the steps of fitting a thermoplastic sleeve having a boss preformed at one end over a needle, forcing the needle and the sleeve through the tissue, bringing the sleeve into contact with a heating element to form a second boss at its other end, and withdrawing the needle from the sleeve.

According to another aspect of the invention there is provided a thermoplastic sleeve having a boss preformed at one end. The sleeve is formed of a sterile plastic which causes no adverse tissue reaction. The sleeve is adapted to be fitted over a needle, forced through tissue along with the needle and into contact with a heating member. The sleeve is made of a plastic material that will melt or deform at a suitable temperature when brought into contact with the heating member.

According to another aspect of the invention there is provided a stand for use with the above mentioned tissue piercing apparatus. The stand includes means for heating the heating member. The stand is adapted so that when the tissue piercing apparatus is placed on it the heating member makes contact with the means for heating whereby the heating member is heated to a suitable temperature to melt or deform plastic.

In a preferred embodiment there is provided an apparatus and stand wherein the heating member comprises a heating coil inside it and the means for heating comprises means for making an electrical contact with the heating member when the apparatus is placed on the stand.

BRIEF DESCRIPTION OF DRAWINGS

In drawings which are illustrative of the invention,

FIG. 2 is a fragmentary cross-sectional view showing a thermoplastic sleeve inserted through the ear, FIG. 3 is a cross-sectional view showing a thermoplastic sleeve retained in place through the ear, and FIG. 4 is side elevation of an ear piercing apparatus retained in a stand.

DETAILED DESCRIPTION OF PREFERRED EMBODIMENT

Figure 1:
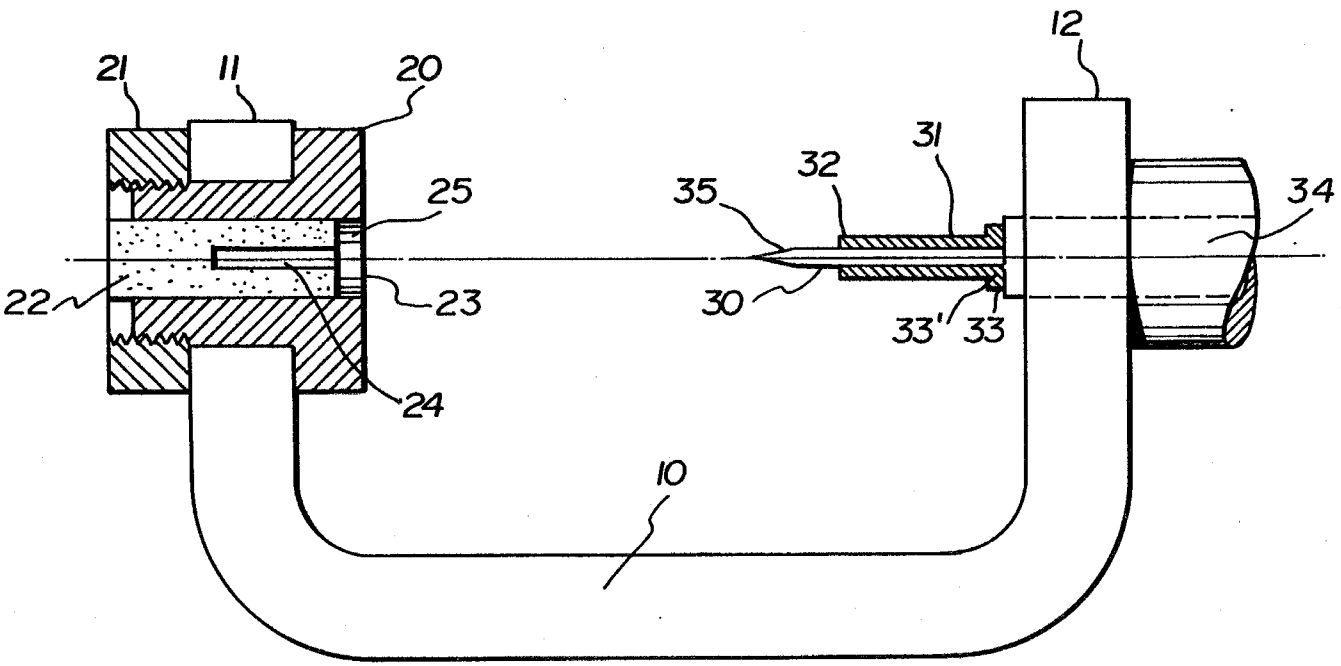
FIG. 1 is a view, partially in section, of an ear piercing apparatus according to the present invention.

Referring to FIG. 1, there is shown a U-shaped support 10 having legs 11 and 12. Attached to leg 12 is means 34 for shifting the needle 30 towards the other leg 11 to pierce an ear. In general, means 34 forms part of the prior art and requires no detailed discussion here.

A hollow bolt 20 with a bore 23 through the centre is fastened in place through leg 11 by nut 21. Inside the bore 23 of bolt 20 is secured a heating element 22 which has an elongated opening 24 for receiving the tip 35 of needle 30 when the latter is fully extended to the left as shown in FIG. 2. A space 25, which serves as a mold, may be left on the inner side of the bore 23 of the bolt 20.

In operation, a thermoplastic sleeve 31 having a boss 33' at one end is placed over the needle 30. The sleeve 31 is placed over the needle so that the end with the boss 33, which will hereinafter be referred as to the distal end, is opposite the tip 35 of needle 30. The other end of the sleeve 32, which will hereinafter be referred to as the proximal end, is thus adjacent to the tip 35 of the needle 30.

The thermoplastic sleeve may be formed of any sterile plastic which causes no adverse tissue reaction. For example the sleeve may be made of "Intramedic" (Trademark) polyethylene of a bland medical formulation.

After the sleeve 31 is placed over the needle 33 the desired portion of an ear is inserted between legs 11 and 12. Means 34 then shifts the needle 30 through the ear so that the tip of the needle is received in the elongated opening 24 of heating member 22. The means for shifting the needle may, as shown in FIG. 4, be a plunger means 36.

The heating member 22 may be made of a material of a type that retains heat such as copper, or may instead have a heating coil inside it which heats up when electrical contact is made as described below.

The bolt 20 is made of a material of low thermal conductivity, such as polytetrafluoroethylene so that little heat is transferred from the heating element 22 to the ear. Also, the space 25 prevents contact of the heating element with the ear. Thus, burning of the ear tissue is prevented.

As shown in FIG. 2, the ear piercing apparatus is so dimensioned that after the needle 30 passes through the earlobe 40 the tip of the needle 35 enters the elongated opening 24 and the proximal end of the sleeve 32 is brought into contact with heating member 22.

The heating member 22 heats the proximal end of the thermoplastic sleeve to a temperature sufficiently high to melt or to at least deform the plastic material of the sleeve thus forming a second boss 32'. The plastic of which the sleeve is made is, of course, selected so that it will melt or deform at a suitable temperature. When the parts are separated, the second boss 32' of course cools and solidifies.

As shown in FIG. 3, after the needle is removed, the sleeve having a boss at each end is retained in place through the ear. The sleeve may then be used immediately as a pivot or a support for a conventional earring even while the wound is healing, unlike the prior art wherein a waiting period is required.

In FIG. 4, there is schematically shown a stand 51 for holding the ear piercing apparatus. When placed in the stand, the heating member 22 of the ear piercing apparatus is brought in contact with an electrical element 50 to heat heating member 22. As an alternative an electrical heating element could be included inside heating member 22. This electrical heating element would then make an electrical connection upon being placed in the stand and thus heat up.

When the heating element 22 reaches a suitable temperature the ear piercing apparatus is removed from the stand and immediately used for piercing an ear as described above.

Although the invention has been described for use with a U-shaped support it is within the scope of the invention to use a pliers shaped apparatus. The needle would then be held in one of the jaws and an anvil means would be formed in the other jaw. Otherwise the apparatus would operate in the manner described above.

What I claim as my invention is:

1. In a tissue piercing apparatus of the type comprising: a first means for supporting a sharp, piercing needle; a second means for supporting an anvil means; means for supportively interconnecting said first and second supporting means in spaced relation and means for shifting said needle towards said anvil means so that tissue interposed between said needle and said anvil means is pierced; the improvement wherein said anvil means comprises a heating member within which is recessed a heating element having an elongated opening for receiving the tip of said needle so that a thermoplastic sleeve having a first boss performed at one end, surrounding said needle, after passing through said tissue, is thermoformed to form a second boss about its other end whereby said sleeve is retained in said tissue.

2. An apparatus according to claim 1 wherein said sleeve is usable as a pivot or a support for an article of jewelery.

3. The improvement claimed in claim 1 further characterized in that said tissue is a portion of the human ear and said sleeve is usable as a pivot or a support for a conventional earring.

4. An apparatus according to claim 1 in which a stand is provided to support said anvil means, said heating element contacting said stand to cause said heating element to be heated.

5. An apparatus according to claim 4 in which said heating element comprises a heating coil having an electrical contact which contacts said stand and said stand supplies electrical current to said heating coil via said electrical contact.

6. An apparatus according to claim 1 in which said heating element is recessed within the bore of a hollow bolt.

* * * * *